US008690016B2

(12) United States Patent
Anderson et al.

(10) Patent No.: US 8,690,016 B2
(45) Date of Patent: Apr. 8, 2014

(54) PRODUCT STORAGE AND HANDLING SYSTEM FOR BEVERAGE DISPENSER

(75) Inventors: Douglas Anderson, St. Charles, IL (US); Karl M. Bogacz, Elk Grove Village, IL (US); Peter S. Tinucci, Wheaton, IL (US); N Sudhir Kumar, Karnataka (IN); Ramakrishnan Anoop, Karnataka (IN)

(73) Assignee: IMI Cornelius Inc., Glendale Heights, IL (US)

( * ) Notice: Subject to any disclaimer, the term of this patent is extended or adjusted under 35 U.S.C. 154(b) by 151 days.

(21) Appl. No.: 12/924,111

(22) Filed: Sep. 21, 2010

(65) Prior Publication Data

US 2011/0073615 A1 Mar. 31, 2011

Related U.S. Application Data

(60) Provisional application No. 61/277,125, filed on Sep. 21, 2009.

(51) Int. Cl.
*B67D 7/74* (2010.01)

(52) U.S. Cl.
USPC ..... 222/129.1; 222/1; 222/105; 222/131; 222/132; 222/143; 222/160

(58) Field of Classification Search
USPC ..... 222/129.1, 105, 131, 132, 135, 142.2, 222/142.3, 142.7, 142.8, 143, 309, 1, 160, 222/183
See application file for complete search history.

(56) References Cited

U.S. PATENT DOCUMENTS

| | | | | | |
|---|---|---|---|---|---|
| 4,688,701 | A * | 8/1987 | Sedam | 222/129.1 |
| 5,114,047 | A * | 5/1992 | Baron et al. | 222/129.1 |
| 5,193,720 | A * | 3/1993 | Mayberry | 222/160 |
| 5,255,822 | A * | 10/1993 | Mease et al. | 222/63 |
| 5,348,192 | A * | 9/1994 | Sardynski et al. | 222/129.1 |
| 5,603,432 | A * | 2/1997 | Sardynski et al. | 222/129.1 |
| 5,797,519 | A * | 8/1998 | Schroeder et al. | 222/129.1 |
| 5,842,603 | A * | 12/1998 | Schroeder et al. | 222/23 |
| 5,967,322 | A * | 10/1999 | Apps et al. | 206/497 |
| 6,497,343 | B1 * | 12/2002 | Teetsel, III | 222/1 |
| 6,510,965 | B1 * | 1/2003 | Decottignies et al. | 222/95 |
| 6,561,386 | B1 * | 5/2003 | Martens | 222/105 |
| 6,708,741 | B1 * | 3/2004 | Berry et al. | 141/362 |
| 6,726,062 | B2 * | 4/2004 | Segiet | 222/129.1 |
| 6,935,532 | B2 | 8/2005 | Tinucci et al. | |
| 7,237,691 | B2 * | 7/2007 | Danby et al. | 222/103 |

(Continued)

*Primary Examiner* — Frederick C Nicolas
(74) *Attorney, Agent, or Firm* — Gifford, Krass, Sprinkle, Anderson & Citkowski, P.C.

(57) ABSTRACT

A product storage and handling system for a beverage dispenser is characterized by a cabinet in which a plurality of bins are removably supported on one or more shelves that may be slid into and out of the cabinet. Each bin is for containing a removable container of liquid beverage component, a fluid valve of which container extends downward through and is releasably secured against vertical movement in a lower opening in the bin. A connector coupled to a fluid line leading to a beverage valve of a beverage dispenser is arranged to be conveniently fluid coupled with and decoupled from the fluid valve of the bag. When a shelf of slid out of the cabinet, the bins supported by it may, if desired, be lifted off of and replaced on the shelf for during replacement of a depleted bag of liquid beverage component. Alternatively, the bins may remain supported on the shelf during replacement of a depleted bag of liquid beverage component.

12 Claims, 5 Drawing Sheets

(56) References Cited

U.S. PATENT DOCUMENTS

| | | | | |
|---|---|---|---|---|
| 7,784,205 | B1 * | 8/2010 | Baron et al. | 40/564 |
| 7,913,878 | B1 * | 3/2011 | Baron et al. | 222/129.1 |
| 7,934,670 | B2 * | 5/2011 | Ford | 241/30 |
| 2002/0005413 | A1 * | 1/2002 | Black et al. | 222/146.6 |
| 2004/0129720 | A1 * | 7/2004 | Cheng et al. | 222/1 |
| 2005/0127098 | A1 * | 6/2005 | Bertone | 222/129.1 |
| 2005/0258186 | A1 * | 11/2005 | Hart et al. | 222/1 |
| 2006/0207997 | A1 * | 9/2006 | Aguirre et al. | 222/1 |
| 2006/0278657 | A1 * | 12/2006 | Roatis | 222/129.1 |
| 2008/0149669 | A1 * | 6/2008 | Nicholson et al. | 222/129.1 |
| 2008/0283550 | A1 * | 11/2008 | Nighy et al. | 222/1 |
| 2009/0235826 | A1 * | 9/2009 | Hart et al. | 99/288 |
| 2010/0003386 | A1 * | 1/2010 | Cheng et al. | 426/330.3 |

* cited by examiner

PRODUCT STORAGE AND HANDLING SYSTEM FOR BEVERAGE DISPENSER

This application claims benefit of provisional application Ser. No. 61/277,125, filed Sep. 21, 2009.

FIELD OF THE INVENTION

The present invention relates to beverage dispensing systems, and in particular to a product storage and handling system for a beverage dispenser, which accommodate convenient storage and replacement of separate disposable containers of liquid beverage components to be delivered to beverage valves of a beverage dispenser.

BACKGROUND OF THE INVENTION

Product dispensing systems, such as beverage or drink dispensers, have supplies or containers of liquid beverage components fluid coupled to dispense valves for mixing and dispensing of drinks for service to customers. The beverage components may comprise beverage concentrates or syrups, along with one or more liquid diluents for mixture with the concentrates or syrups to provide a desired beverage. The beverage components are desirably chilled, so that a cold drink drawn from the dispenser for service to a customer is not warm and degraded in quality by excessive melting of ice. Chilling of the beverage components can be accomplished in any suitable manner, such as by refrigerating an interior of a cabinet in which the supply containers are maintained or by flowing the beverage components through a cold plate as they are delivered to the beverage dispensing valves. The supplies of liquid beverage components may be located either near or remote from the dispenser and the components are delivered by pumps through fluid supply lines from the supplies to individual ones of a plurality of beverage valves of a dispenser. One such beverage dispenser of a type having dispense valves for being fluid coupled to supplies of liquid beverage components is taught by U.S. Pat. No. 6,935,532, the teachings of which are incorporated herein by reference.

When a liquid beverage component supply container is depleted, it is replaced with a fresh supply container. Replacement requires that the fluid connection of its associated fluid supply line be removed and then reconnected to the fresh supply container, which removal and replacement of the fluid connection and container can be tedious and time consuming when the supply containers are stored, as is usually the case, in close proximity to one another within a cabinet.

OBJECT OF THE INVENTION

A primary object of the present invention is to provide a beverage component storage and handling system for a beverage dispenser, which accommodates convenient storage and replacement of disposable containers of liquid beverage components that are fluid coupled to dispense valves of a beverage dispenser.

SUMMARY OF THE INVENTION

According to the present invention, there is provided a product storage and handling system for a beverage dispenser that comprises a cabinet having a shelf; a bin removably supported on the shelf, the bin having side walls, an open upper end and a passage in a bottom wall thereof; a container of liquid beverage component removably carried in the bin, the container having a fluid valve extending through the bin bottom wall passage; means for releasably securing the container fluid valve against substantial vertical movement in the bin bottom wall passage; and a fluid connector for releasably fluid coupling with the container fluid valve to receive liquid beverage component from the container for delivery of the liquid beverage component from the container to the beverage dispenser.

In a preferred embodiments of the system, the shelf is mounted for sliding movement into and out of the cabinet and has an opening accommodating passage therethrough of the container fluid valve when the bin bottom wall is supported on the shelf; the container valve is an LMS valve; the means for releasably securing comprises recess means on the container fluid valve for receiving a peripheral edge of the bin bottom wall passage when the valve extends through the passage; the bin bottom wall passage has an enlarged portion and a smaller portion and the container valve is extendable through the enlarged portion and then slidable into the smaller portion to receive the peripheral edge of the bin bottom wall passage in the container valve recess means; the fluid connector comprises an elbow connector having a first end for extension into a passage in the container fluid valve to establish communication with an interior of the container and a second end for fluid coupling with the beverage dispenser; and the container comprises a flexible bag of liquid beverage component.

The invention also contemplates a method of storing and handling product to be delivered to a beverage dispenser, which comprises the steps of mounting a shelf in a cabinet; removably supporting a bin on the shelf, the bin having side walls, an open upper end and a passage in a bottom wall that rests on the shelf; placing a container of liquid beverage component into the bin to extend a fluid valve of the container through the passage in the bottom wall of the bin; releasably securing the container fluid valve against substantial vertical movement in the bin bottom wall passage; and fluid coupling a fluid connector with the container fluid valve to receive liquid beverage component from the container for flow of beverage component from the fluid connector to a dispense valve of the beverage dispenser.

According to preferred embodiments of the method, the mounting step mounts the shelf for sliding movement into and out of the cabinet, the shelf has an opening and the removably supporting step includes extending the container fluid valve through the shelf opening when the bin is supported on the shelf; the container valve is an LMS valve; the releasably securing step comprises providing a recess in the container valve and moving the container valve in the bin bottom wall passage to receive a peripheral edge of the bin bottom wall in the recess; the bin bottom wall passage has an enlarged portion and a smaller portion and performance of the placing step comprises extending the container valve through the enlarged portion and then moving the container valve into the smaller portion to receive the peripheral edge of the bin bottom wall passage in the recess in the container valve; the fluid connector is an elbow connector, the fluid coupling step comprises extending a first end of the elbow connector into a passage in the container fluid valve to establish communication with an interior of the container, and included is the step of providing a fluid path from a second end of the elbow connector to a dispense valve of the beverage dispenser; and the container comprises a flexible bag of liquid beverage component.

DETAILED DESCRIPTION

Figure 1:
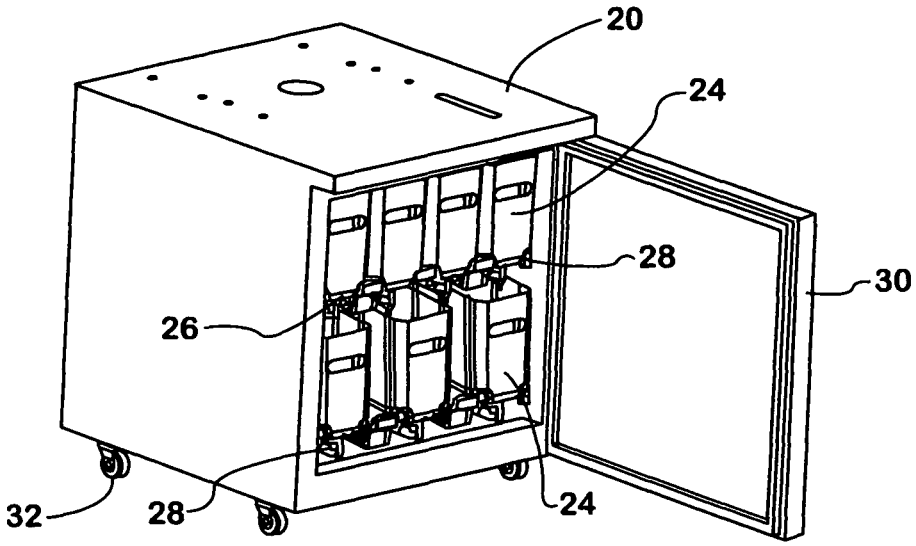
FIG. 1 is view of a cabinet for containing supply containers of liquid beverage components that are disposed in bins carried on sliding shelves.
Figure 6:
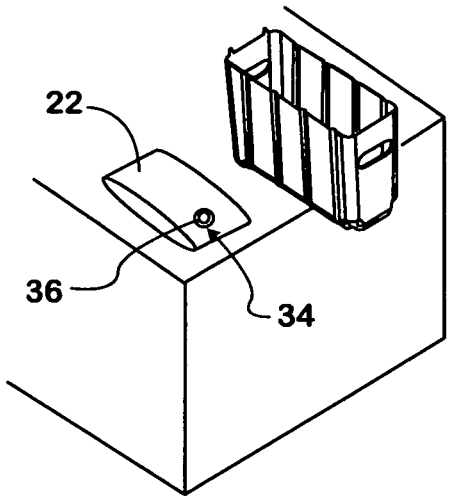
FIG. 6 is a view of a bin and an inverted liquid beverage component supply container to be placed in the bin.
Figure 7:
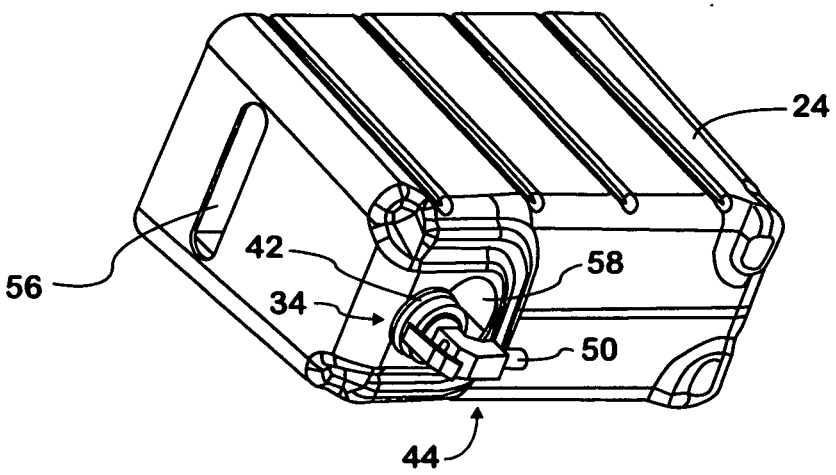
FIG. 7 shows an elbow connector fluid coupled with an LMS valve of a beverage component container, which LMS valve is extended through an opening in the bottom of a bin.
Figure 8:
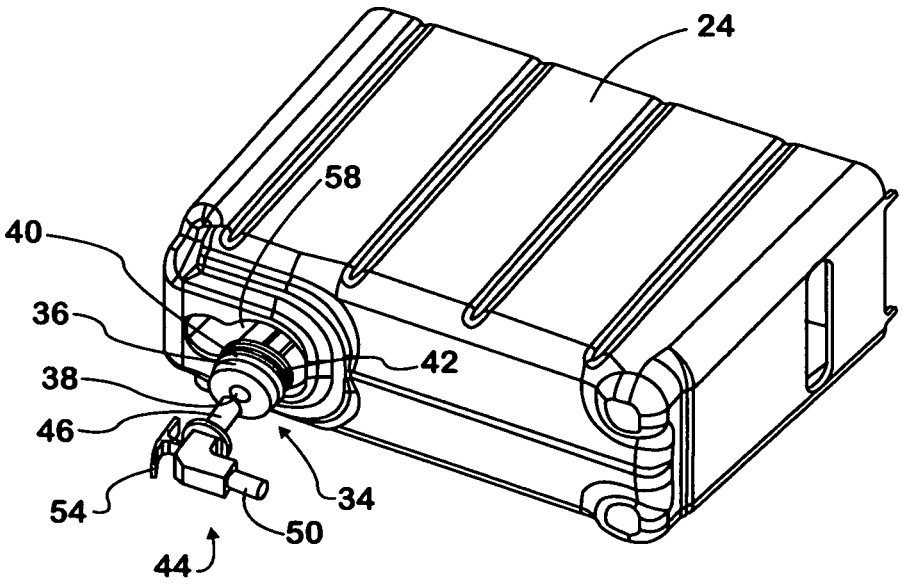
FIG. 8 is similar to FIG. 7 and shows the elbow connector oriented to be fluid coupled with the LMS valve of the beverage component container.
Figure 9:
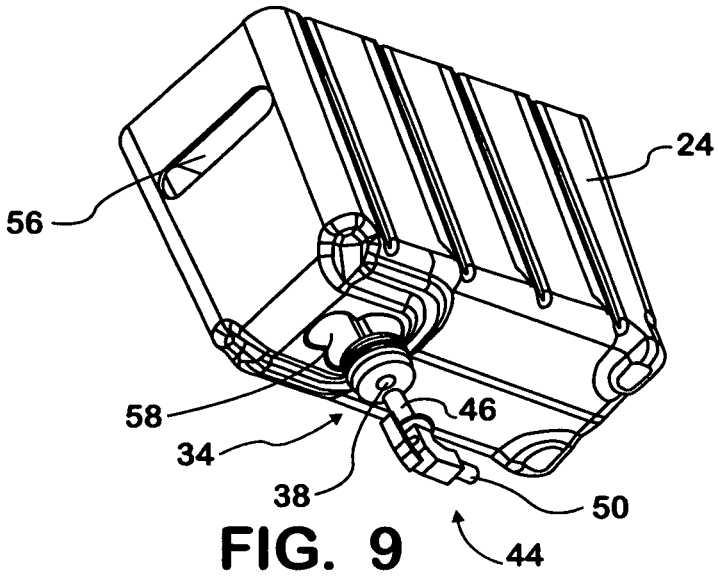
FIG. 9 is similar to FIG. 8.
Figure 10:
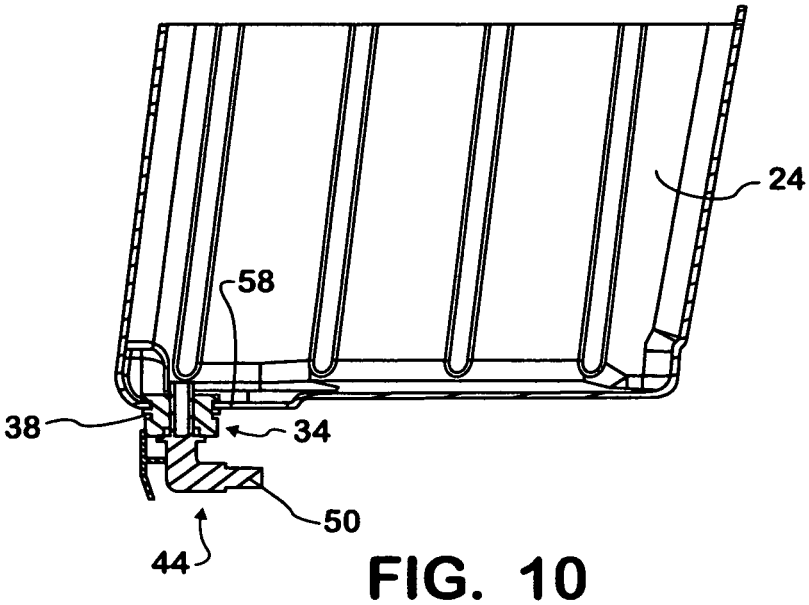
FIG. 10 is a side elevation view of a bin and elbow connector fluid coupled to the LMS valve of a beverage component container in the bin.

As seen in FIG. 1, within a cabinet 20 is a plurality of supply containers or bags 22 (see FIG. 6) of liquid beverage components that are each disposed in an associated one of a plurality of bins 24 carried on sliding shelves 26. For the arrangement shown there are 2 shelves and 7 bins, 4 bins on the top shelf and 3 the bottom shelf. It is to be understood, however, that depending upon the number of supply containers of liquid beverage components to be stored, the cabinet 20 can be appropriately sized to accommodate more or fewer shelves and more or fewer bins that are carried on the shelves. Opposite sides of each shelf 26 are slidably carried on rails 28 mounted on opposite side walls of the cabinet 20 to accommodate sliding movement of the shelves and bins carried by the shelves out of and into the cabinet. A door 30 is hinged to the cabinet and movable between positions opening and closing the cabinet.

As will be described, the supply containers 22 of liquid beverage components or ingredients that are stored in the cabinet 20 are fluid coupled to beverage valves of a beverage dispenser (neither shown) for being dispensed into a cup for service of a drink to a customer. The beverage dispenser may be of a type as described in aforementioned U.S. Pat. No. 6,935,532, the teachings of which have been incorporated herein by reference. When such a beverage dispenser is used, it may be mounted directly atop the cabinet 20 or it may be countertop mounted with the cabinet then being located either below the countertop and dispenser or at a remote location. Alternatively, the cabinet may be an integral lower part of a beverage dispensing apparatus and can have rollers 32 to facilitate its movement.

The supply containers or bags 22 of liquid beverage components can comprise beverage concentrates or syrups, in which case a diluent that may be plain or carbonated water can be delivered to the beverage dispensing valves along with the beverage components. To ensure that a quality beverage is dispensed for service to a customer, means (not shown) are provided for chilling the beverage components and any diluent delivered to the beverage valves. Such means can comprise a refrigeration system for chilling the interior of the cabinet 20 within which the supplies of beverage components are stored, and in the case of a beverage dispenser that also dispenses ice, the refrigeration system can also service an icemaker for the dispenser. Alternatively or in addition to chilling the cabinet interior with a refrigeration system, the chilling means can comprise a cold plate through which the beverage components are flowed prior to being delivered to the beverage valves. The supplies of beverage components in the cabinet 20 are coupled to the beverage dispensing valves through fluid lines, and means (not shown) may advantageously be provided to chill the fluid lines along the path of their extension between the cabinet and dispensing valves.

The beverage component supply containers 22 are contemplated to be flexible bags of liquid beverage components, each provided with an appropriate valve, such as an LMS (Liquid Molding System) valve, indicated generally at 34, which is a valve utilizing a silicon member in which there is a "+" shaped cut that normally is closed but through which a fluid connector can be moved to establish fluid communication with the liquid beverage component in the bag interior. One such LMS valve 34 is shown in FIGS. 3 and 5-10, and with particular reference to FIG. 5, the valve comprises a generally cylindrical body member 36 having a fluid passage 38 extending axially therethrough. The body member 36 has a pair of axially spaced circumferential recesses 40 and 42, the purpose of which recess 40 will later be described, and the body member is sealed at one end to and about an opening in the flexible bag 22, such that an inner end of the axial passage 38 communicates with the bag interior. The silicon member in which there is the "+" shaped cut is in and normally closes the passage 38, so that liquid beverage component in the bag does not unintentionally flow out of the bag through the passage.

The liquid beverage component in each bag 22 is accessed via an associated elbow connector, indicated generally at 44. The elbow connector has a tubular inlet extension 46 that may be manually moved into the passage 38 of the LMS valve 34 and through the "+" shaped cut in the silicon member in the passage to place an inlet to a passage 48, extending through the tubular inlet extension, into fluid communication with liquid beverage component in the bag. From the tubular inlet extension 46 the passage 48 extends through a barb fitting 50 of the elbow connector to an outlet from the passage at an end of the barb fitting, whereby liquid beverage component in the bag may be flowed out of the bag through the passage 48 in the elbow connector 44. The barb fitting attaches to an appropriate flexible tubing 52 (FIG. 3) that provides a fluid flow path for the liquid beverage component through a pump (not shown) to a beverage valve of the beverage dispenser (neither shown), such that operation of the pump draws liquid beverage component from the bag 22 and through the LMS valve, elbow connector and flexible fluid line to the beverage valve. When the bag 22 is emptied of liquid beverage component, the tubular extension 46 of the elbow connector 44 can be withdrawn and released from the passage 38 in the LMS valve 34, whereupon the "+" shaped cut in the silicon member in the passage closes to prevent leakage from the bag through the LMS valve. A handle 54 on the elbow connector 44 facilitates manual manipulation of the elbow connector in its connection and disconnection with and from the LMS valve 34.

Figure 2:
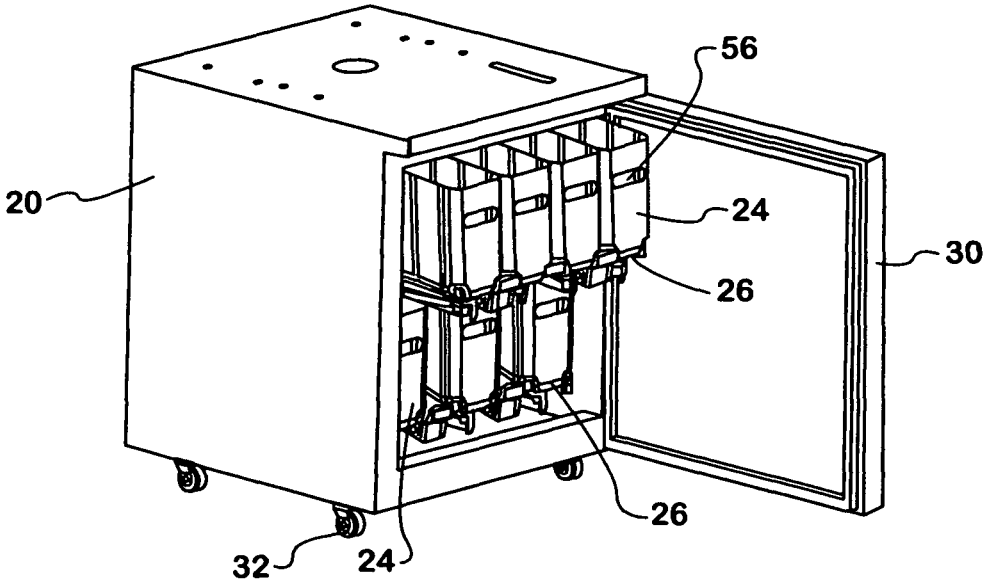
FIG. 2 is similar to FIG. 1 and shows a top shelf of the cabinet slid out to provide access to bins carried by the shelf.
Figure 3:
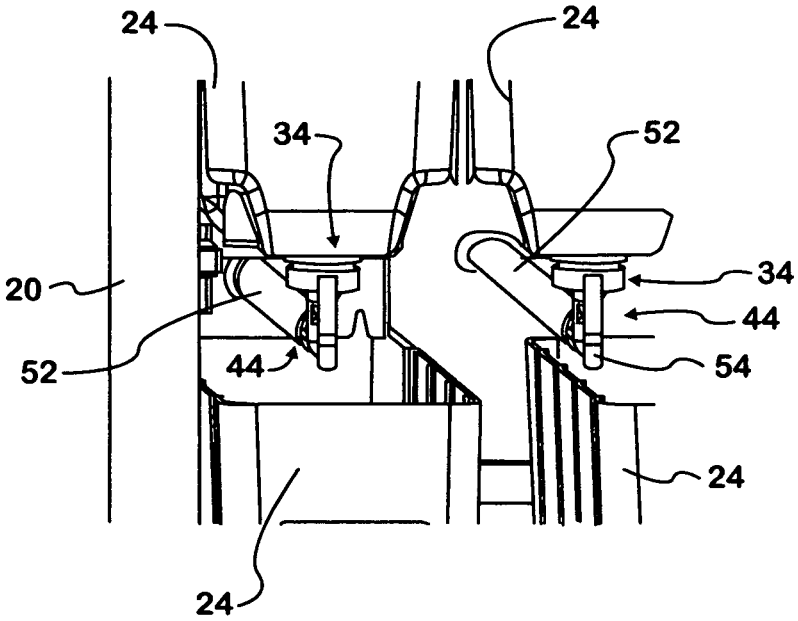
FIG. 3 is a fragmentary view of bins in the cabinet, showing fluid connections to supply containers of liquid beverage components disposed in the bins.
Figure 4:
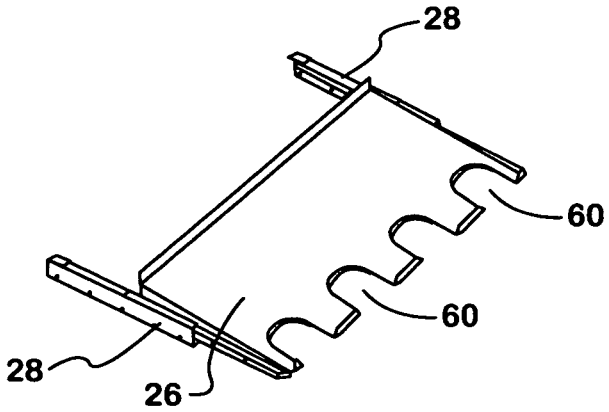
FIG. 4 shows a cabinet sliding shelf for supporting bins in the cabinet.
Figure 5:
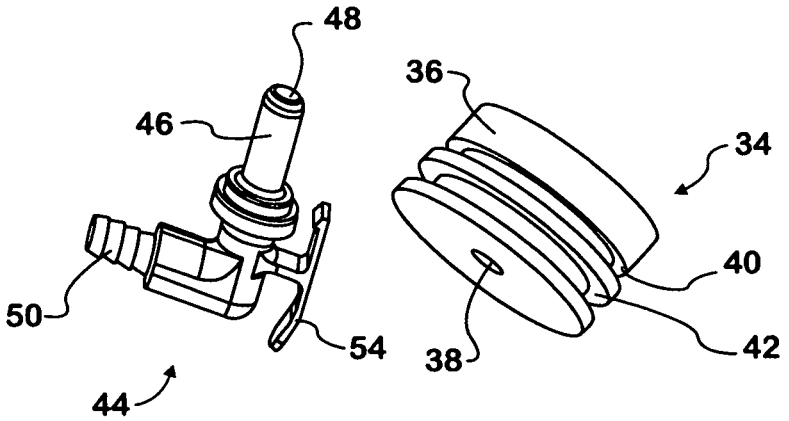
FIG. 5 is a view of an elbow connector and an LMS (Liquid Molding Systems) valve of a beverage supply container with which the elbow connector fluidly connects.

The arrangement by which the supply bags 22 of beverage components are carried in the bins 24, by which the bins are supported on the sliding shelves 26 in the cabinet 20, and by which the elbow connectors 44 are fluid coupled to the LMS valves of the bags for flow of liquid beverage components to beverage dispensing valves, facilitates convenient loading and replacement of depleted beverage component supply bags in the cabinet. In particular, to load bags of liquid beverage components into the cabinet 20, a shelf 26 of the cabinet is slid forward out of the cabinet, such as is seen in FIG. 2. One or more of the bins 24 carried by the shelf may then be lifted off of the shelf, with an slot 56 in a front wall of the bins providing a means by which an operator can easily grip the bins to lift them off of the shelf, or the bins can be left in place on the shelf. With the bins either in place on or removed from the shelf, a liquid beverage component bag, such as the bag 22 which is shown upside down in FIG. 6 to illustrate the location of its LMS valve 34, is placed in each bin in an orientation such that its LMS valve faces downward and is toward a front wall of the bin. Each bin is provided with a pear-shaped passage or opening 58 in its bottom wall toward its front wall, which pear-shaped opening has an enlarged portion away from the bin front wall that is large enough to accommodate extension therethrough of the cylindrical body member 36 of the LMS valve of a bag 22 and a smaller portion toward the bin front wall that has a width slightly smaller than the outside diameter of the of the cylindrical body member. When a bag is placed into a bin, the cylindrical body member of the LSM valve is first extended downward through the enlarged portion of the pear-shaped opening 58 in the bin bottom wall. The cylindrical body member of the valve is then manually moved forward into the smaller forward portion of the pear-shaped opening, so that peripheral edges of the bin bottom wall that define the smaller portion of the pear-shaped opening 58 move into the circumferential recess 40 in the cylindrical body member 36 of the LMS valve, thereby to secure the LMS valve against vertical movement relative to the bin.

After the bins 24 are loaded with bags 22 full of liquid beverage components, they are placed back onto the cabinet shelf 26 if previously removed therefrom, or are otherwise left in place on the shelf. In either case, laterally spaced openings 60 in a front edge of the shelf accommodate downward extension therethrough of the LMS valves 34 of the bags of beverage components that have been placed in the bins. The tubular inlet extensions 46 of the elbow connectors 44 associated with the LMS valves 34 of the bags 22 are then moved into the axial passages 38 of the valves to fluid couple the contents of the bags through fluid lines 52 to dispense valves of a beverage dispenser. During fluid coupling of each elbow connector to its LMS valve, receipt of the edges of the bin bottom wall within the valve recess 40 secures the valve against upward movement as the elbow connector is extended into it, thereby facilitating establishment of the fluid connection. The cabinet shelf is then slid backward into the cabinet 20 and the cabinet door 30 is closed.

Upon depletion of a bag 22 of liquid beverage component, as may be detected in any suitable manner well understood by those of skill in the art, the door 30 of the cabinet is opened and the shelf 26 supporting the bin 24 in which the depleted bag is carried is slid forward out of the cabinet. The elbow connector 44 fluid coupled to the LMS valve 34 of the depleted bag is then uncoupled from the LMS valve, whereupon the LMS valve is manually slid rearward into the enlarged rearward portion of the pear-shaped opening 58 so that it is released for vertical movement out the opening, at which point the depleted bag can then be lifted out of the bin and replaced with a fresh bag of liquid beverage component in the manner above described.

The invention therefore provides an improved liquid beverage component handling and storage system for a beverage dispenser, which accommodates convenient storage of bags of liquid beverage components for delivery to dispense valves of a beverage dispensing machine. The arrangement also accommodates convenient replacement of depleted bags of beverage components. While the valve carried by each bag of liquid beverage component has been described as an LMS valve, it is understood that any other suitable type of valve and connector for fluid coupling with the valve may be used in practice of the invention.

While embodiments of the invention have been described in detail, various modifications and other embodiments thereof may be devised by one skilled in the art without departing from the spirit and scope of the invention, as defined in the appended claims.

What is claimed is:

1. A product storage and handling system for a beverage dispenser, comprising:

a cabinet having a shelf;

a bin removably supported on said shelf, said bin having side walls, an open upper end and a passage in a bottom wall thereof, said passage including pear shaped opening including an enlarged portion co-planar and continuous with a smaller portion;

a container of liquid beverage component removably carried in said bin, said container having a fluid valve extending through said bin bottom wall passage;

a recess formed on said container fluid valve receiving a peripheral edge of said bin bottom wall passage when said valve extends through said passage securing said container fluid valve against substantial vertical movement in said bin bottom wall passage and a fluid connector for releasably fluid coupling with said container fluid valve to receive liquid beverage component from said container for delivery of the liquid beverage component from said container to the beverage dispenser.

2. A system as in claim 1, wherein said shelf is mounted for sliding movement into and out of said cabinet and has an opening accommodating passage therethrough of said container fluid valve when said bin bottom wall is supported on said shelf.

3. A system as in claim 1, wherein said container valve includes a silicon body having a passage formed therein and a cross shaped opening formed in the body reversibly sealing the passage.

4. A system as in claim 1, wherein said container valve is extendable through said enlarged portion and then slidable into said smaller portion to receive said peripheral edge of said bin bottom wall passage in said container valve recess.

5. A system as in claim 1, wherein said fluid connector comprises an elbow connector having a first end for extension into a passage in said container fluid valve to establish communication with an interior of said container and a second end for fluid coupling with the beverage dispenser.

6. A system as in claim 1, wherein said container comprises a flexible bag of liquid beverage component.

7. A method of storing and handling product to be delivered to a beverage dispenser, comprising the steps of:

mounting a shelf in a cabinet;

removably supporting a bin on the shelf, the bin having side walls, an open upper end and a passage in a bottom wall that rests on the shelf, the passage including an enlarged portion co-planar and a smaller portion;

placing a container of liquid beverage component into the bin to extend a fluid valve of the container through the passage in the bottom wall of the bin, the fluid valve including a recess formed thereon;

releasably securing the container fluid valve against substantial vertical movement in the bin bottom wall passage by extending the container valve through the enlarged portion and then moving the container valve into the smaller portion to receive the peripheral edge of the bin bottom wall passage in the recess in the container valve; and fluid coupling a fluid connector with the container fluid valve to receive liquid beverage component from the container for flow of beverage component from the fluid connector to a dispense valve of the beverage dispenser.

8. A method as in claim 7, wherein said mounting step mounts the shelf for sliding movement into and out of the cabinet, the shelf has an opening and said removably supporting step includes extending the container fluid valve through the shelf opening when the bin is supported on the shelf.

9. A method as in claim 7, wherein the container includes a silicon body having a passage formed therein and a cross shaped opening formed in the body reversibly sealing the passage.

10. A method as in claim 7, wherein the fluid connector is an elbow connector, said fluid coupling step comprises extending a first end of the elbow connector into a passage in the container fluid valve to establish communication with an interior of the container, and including the step of providing a fluid path from a second end of the elbow connector to a dispense valve of the beverage dispenser.

11. A method as in claim 7, wherein the container comprises a flexible bag of liquid beverage component.

12. A product storage and handling system for a beverage dispenser, comprising:

a cabinet having a shelf;

a bin removably supported on said shelf, said bin having side walls, an open upper end and a passage in a bottom wall thereof;

a container of liquid beverage component removably carried in said bin, said container having a fluid valve extending through said bin bottom wall passage;

a recess formed on said container fluid valve securing said container fluid valve against substantial vertical movement in said bin bottom wall passage and a fluid connector including an elbow connector having a first end for extension into a passage in said container fluid valve to establish communication with an interior of said container and a second end for fluid coupling with the beverage dispenser.

* * * * *